US006082418A

United States Patent [19]

Naecker et al.

[11] Patent Number: 6,082,418

[45] Date of Patent: Jul. 4, 2000

[54] ASEPTIC CONTAINER FILLING ASSEMBLY

[75] Inventors: Jens Naecker, Hamburg; Wolfgang Wilke, Hoisdorf, both of Germany

[73] Assignee: Crown Simplimatic Incorporated, Lynchburg, Va.

[21] Appl. No.: 09/325,300

[22] Filed: Jun. 3, 1999

Related U.S. Application Data

[63] Continuation-in-part of application No. 09/095,219, Jun. 10, 1998, abandoned.

[51] Int. Cl.[7] ..... B65B 31/02; B65B 55/10; B67C 7/00

[52] U.S. Cl. ..... 141/145; 141/6; 141/7; 141/49; 141/51; 141/39; 141/94; 141/147; 141/371; 141/372; 53/306; 53/329

[58] Field of Search ..... 141/5–7, 39, 40, 141/47–49, 51, 59, 62, 63, 94, 97, 144–150, 152, 370–372; 53/306, 329

[56] References Cited

U.S. PATENT DOCUMENTS

| | | | |
|---|---|---|---|
| 2,565,045 | 8/1951 | Ray | 141/51 |
| 2,642,216 | 6/1953 | Carter | 141/51 |
| 2,783,786 | 3/1957 | Carter . | |
| 2,839,093 | 6/1958 | McCarthy | 141/51 |
| 2,862,528 | 12/1958 | Geisler . | |
| 2,885,845 | 5/1959 | Ryan, Jr. . | |
| 4,060,107 | 11/1977 | Naftulin . | |
| 5,031,673 | 7/1991 | Clusserath . | |
| 5,123,993 | 6/1992 | Wiggins | 141/144 |
| 5,240,048 | 8/1993 | Deihl . | |
| 5,398,734 | 3/1995 | Hartel | 141/48 |
| 5,450,882 | 9/1995 | Cragun | 141/39 |

FOREIGN PATENT DOCUMENTS

| | | |
|---|---|---|
| 251440 | 1/1967 | Austria . |
| 1642102 | 8/1974 | Germany . |
| 4126136 | 2/1993 | Germany . |
| 384229 | 1/1965 | Switzerland . |
| 1212503 | 12/1966 | United Kingdom . |
| 1212503 | 11/1970 | United Kingdom . |

OTHER PUBLICATIONS

European Search Report Sep. 01, 1999.

*Primary Examiner*—J. Casimer Jacyna
*Attorney, Agent, or Firm*—Howard & Howard

[57] ABSTRACT

A container filling assembly (10) including a carousel (12) having an in-feed station (20) and an exit station (30) for supplying empty containers (22) and exiting filled containers (22). A number valve stations (34) are supported by the carousel (12) for filling the containers (22). An enclosure (42) is associated with each valve station (34) for enclosing the container (22) on the valve station (34). The enclosure (42) has an elongated endless wall (44) with an upper periphery (46) for sealing engagement about at the valve station (34). An actuation device (48) moves the enclosure (42) vertically between a sealed position with the valve station (34) and an open position spaced vertically from the valve station (34). A bottom (50) is disposed within the endless wall (44) to create a sealed chamber (70) when the endless wall (44) is in the sealed position. The filling assembly (10) is characterized by the bottom (50) being fixed to the carousel (12) and remaining below the upper periphery (46) of the endless wall (44) during the movement of the enclosure (42). The subject invention also includes a method of dispensing the product into the container (22) through the plurality of valve stations (34). The method is likewise characterized by moving the elongated endless wall (44) of the enclosure (42) vertically between the sealed position and the open position while maintaining the upper periphery (46) above the bottom (50).

28 Claims, 3 Drawing Sheets

19
33
52
38
49
64
48
43
44
58
62
60
66
51
50
72
35
34
29
36
37
40
54
46
42
44
27
52
56
36
12
49
78
80

12
19
16
14
18
18
19
18
19
10
31
32
22
30
20
68
64
22
28
24
21
26

19
52
43
42
44
22
41
60
62
33
58
54
74
76
50
51
70
29
35
34
36
38
37
40
46
56
72
27
12
78
80

19
46
41
43
49
39
38
33
66
48
44
60
58
50
72
76
70
35
34
36
37
40
51
54
74
27
56
22
42
80
29
12
78
49

ASEPTIC CONTAINER FILLING ASSEMBLY

RELATED APPLICATION

This patent application is a Continuation-in-Part of U.S. Pat. application Ser. No. 09/095,219 which was filed on Jun. 10, 1998 and entitled "Aseptic Container Filling Assembly", now abandoned.

BACKGROUND OF THE INVENTION

1) Technical Field

The subject invention relates to a container filling assembly for filling a plurality of containers with a product in a sterile environment.

2) Description of the Prior Art

In the beverage industry, containers, which can include aluminum, glass, or plastic cans or bottles, are typically filled with a product through a valve filling station. The products can include fruit juices, carbonated beverages, water and the like. The prior art valve filling stations operate effectively for aluminum cans, glass bottles and for plastic bottles having sufficient rigidity.

Many of today's plastic bottles, however, include relatively thin walls with a rigid annular neck having a threaded top. The thin walls have a tendency to collapse, expand and/or balloon during the filling process. The collapsing and ballooning of the bottles is undesirable for a number of reasons. First, the accuracy of the filling is compromised. Also, the bottle will have an aesthetically displeasing shape. These types of plastic bottles are typically called PET bottles and are available in a variety of sizes, such as 12 oz., 20 oz., and 1 liter. The plastic bottles are typically carried through a container filling assembly by a neck ring on the rigid annular neck.

It is desirable to eliminate the collapsing, expanding and/or ballooning of the PET bottles during the filling process. One contemplated solution simultaneously maintains equal pressure within the bottle and around the exterior of the bottle. This can be accomplished by creating a sealed chamber around the bottle. The sealed chamber also maintains a sterile environment, i.e., free of bacteria, around the exterior of the bottle and assists in maintaining the sterile environment within the bottle.

This solution has been contemplated by the prior art. Specifically, U.S. Pat. Nos. 2,885,845 and 5,031,673 disclose such a solution. These prior art patents include a valve filling station having a fixedly secured downwardly projecting enclosure. The container rests upon a base which moves vertically to position the container within the enclosure. The base then seals with the bottom section of the enclosure. Another solution contemplated by the prior art is shown in British Patent No. 1,212,503. This filling mechanism has a moveable enclosure along with a moveable base. The enclosure extends below the base during the insertion and removal of the containers. The bottle is placed onto the base and then the enclosure and base move upward to fill the container. These prior art designs, however, have a number of deficiencies.

One of the primary deficiencies is the prior art designs have not contemplated the new PET bottles which are carried by the neck through the container filling assembly. The continuous movement of the base carrying the bottle creates excessive wear on the filling mechanism. Current methods of performing filling operations with the light weight PET bottles is not as efficient as desired. Further, many of these prior art designs have difficulty accommodating different size containers.

Hence, it is desirable to have a container filling assembly which incorporates an enclosure for creating a sealed chamber around a PET bottle such that the PET bottle does not balloon or collapse during the filling process. It is also desirable to have a container filling assembly which can accommodate different size bottles.

SUMMARY OF THE INVENTION AND ADVANTAGES

A container filling assembly for filling a plurality of containers. The filling assembly comprises a carousel for rotating about an axis. An in-feed station is disposed adjacent the carousel for feeding empty containers into the carousel. An exit station is disposed adjacent the carousel for exiting filled containers from the carousel. A plurality of valve stations are supported by the carousel for filling the containers as the containers are moved by the carousel between the in-feed and exit stations. An enclosure is associated with each valve station for enclosing the container on the valve station. The enclosure has an elongated endless wall with an upper periphery for sealing engagement about the valve station. An actuation mechanism moves the enclosure vertically between a sealed position with the upper periphery in the sealing engagement and an open position with the upper periphery spaced vertically from the valve station sufficiently for the container to move out of and into the valve station above the upper periphery. The enclosure includes a bottom disposed within the elongated endless wall for creating a sealed chamber when the endless wall is in the sealed position. The filling assembly is characterized by the bottom being fixedly supported by the carousel and remaining below the upper periphery of the endless wall during the movement of the enclosure from the sealed position to the open position.

The subject invention also includes a method of dispensing a product into the container through the plurality of valve stations mounted to the revolving carousel. The method comprises the steps of: feeding the container from the in-feed station to the carousel and placing the container in fluid communication with the valve station; disposing the endless wall and bottom around the container to create the sealed chamber for providing a sterile environment for the container; evacuating any fluid from the interior of the container and the sealed chamber; pressurizing the interior of the container and the sealed chamber; filling the container with the product through the valve station; and removing the sealed chamber from around the container for the container to be exited from the carousel along the exit station. The method is characterized by moving the elongated endless wall of the enclosure vertically between a sealed position with the upper periphery in sealing engagement with the valve station to create the sealed chamber and an open position with the upper periphery spaced vertically from the valve station and remaining above the bottom for allowing the container to move out of and into the valve station above the upper periphery and the bottom.

Accordingly, the subject invention provides for a sealed chamber around a container wherein the container may be transported through the container filling assembly and into and out of the enclosure by the neck or top of the container. The bottom remains stationary relative to the carousel during the filling of the containers which creates a more efficient filling mechanism. In addition, the subject invention provides for a sealed chamber which can accommodate different sized containers.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
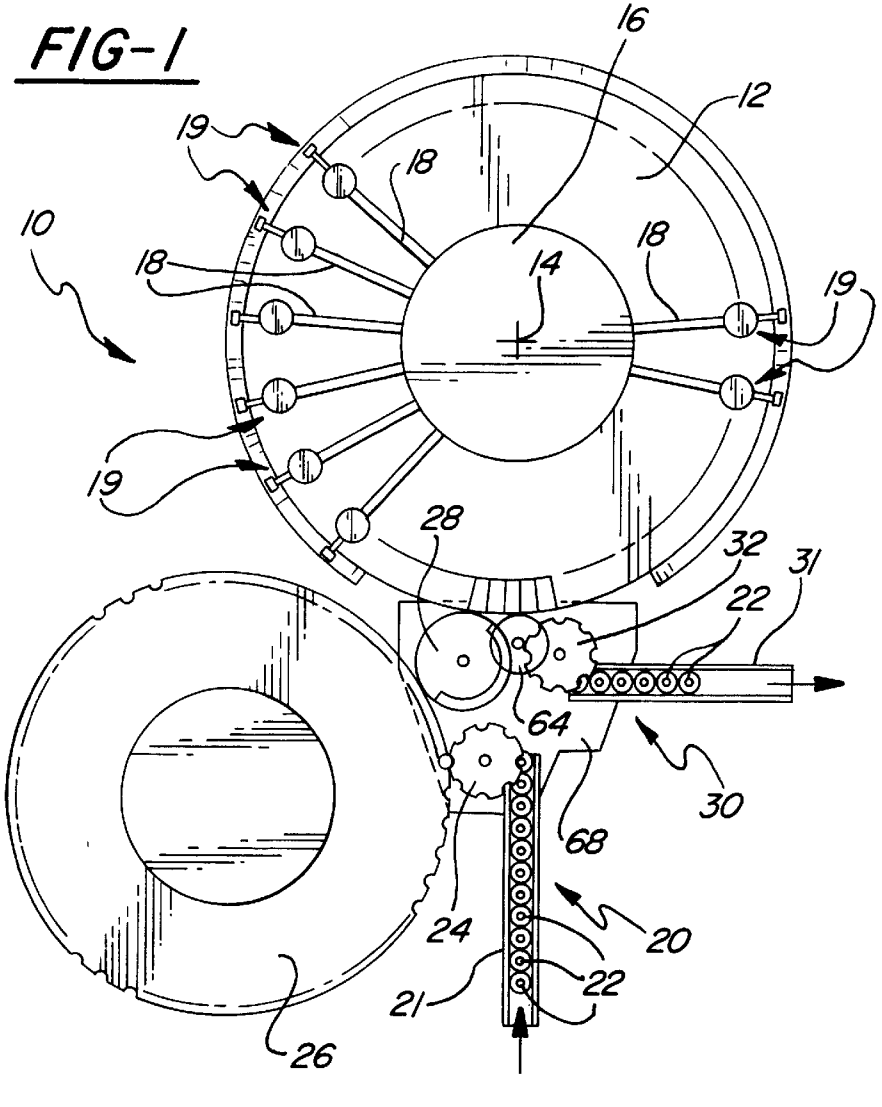
FIG. 1 is an overhead schematic view of a container filling assembly incorporating the subject invention.

Referring to the figures wherein like numerals indicate like or corresponding parts throughout the several views, a container filling assembly is generally shown at 10 in FIG. 1. The container filling assembly 10 includes a carousel 12 for rotating about an axis 14. The carousel 12 includes a central product tank 16 and a plurality of product supply pipes 18. Each of the product supply pipes 18 extend radially from the product tank 16 to a corresponding work station, generally shown at 19. The work stations 19 will be discussed in greater detail hereinbelow.

An in-feed station, generally shown at 20, is disposed adjacent the carousel 12 for feeding empty containers 22 into the carousel 12. The containers 22 are preferably plastic bottles 22 having relatively thin walls with a rigid annular neck (not numbered) and a threaded top 39. These types of plastic bottles or containers 22 are typically called PET bottles and are available in a variety of sizes, such as 12 oz., 20 oz., and 1 liter. As will be discussed in greater detail below, the plastic bottles 22 are typically carried through the container filling assembly 10 by the rigid annular neck.

The in-feed station 20 includes a chute 21 and an in-feed wheel 24. The chute 21 guides the containers 22 from a supply source (not shown) into the in-feed wheel 24. The in-feed wheel 24 includes a number of notches or grooves (not numbered) for supporting and retaining the neck of the container 22. The in-feed wheel 24 in turn supports and transfers the containers 22 into a precleaning station 26. The precleaning station 26 is mounted between the in-feed station 24 and the carousel 12 for cleaning and rinsing the containers 22 before entering the carousel 12. The precleaning station 26 cleans, rinses and sterilizes the containers 22 with ionized air, ozone ($O_3$), hydrogen peroxide ($H_2O_2$), and/or water is well known in the art.

The containers 22 are then transferred into a transfer station 28. The transfer station 28 is disposed between the precleaning station 26 and the carousel 12 for transferring the containers 22 from the precleaning station 26 to the carousel 12. Transfer stations of this type are well known in the art.

An exit station, generally shown at 30, is disposed adjacent the carousel 12 for exiting filled containers 22 from the carousel 12. The exit station 30 also includes a chute 31 and an exit wheel 32 for transferring the filled containers 22 to a desired location. The exit wheel 32 has a number of notches or grooves (not numbered) for supporting and retaining the neck of the containers 22. The exit wheel 32 transfers the containers 22 from the carousel 12 to the chute 31.

Figure 2:
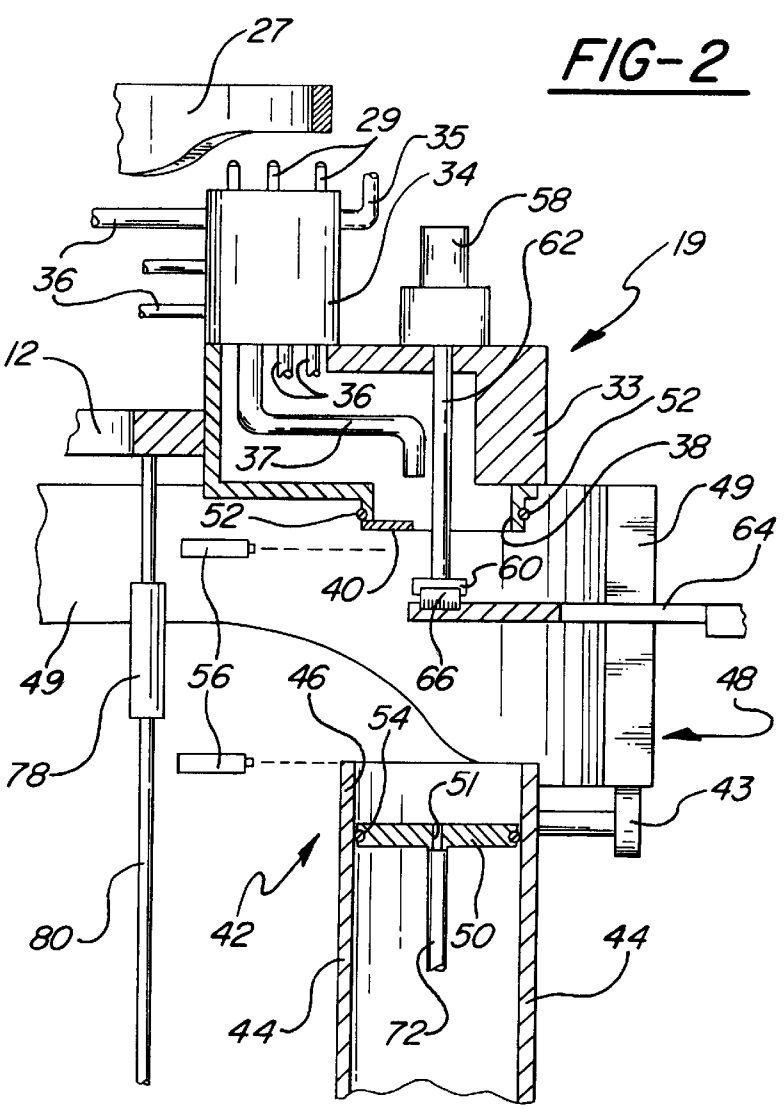
FIG. 2 is a partially cross-sectional side view of a work station during a cap reloading process.
Figure 4:
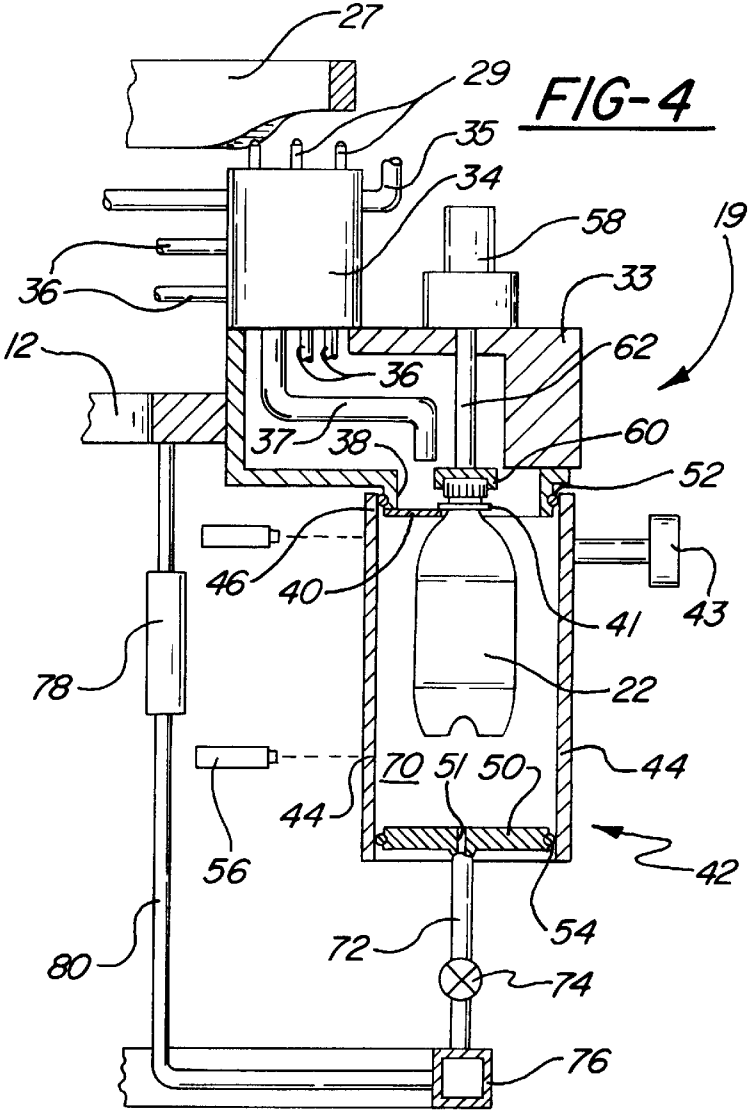
FIG. 4 is a partially cross-sectional side view of the work station during the capping of the container.
Figure 3:
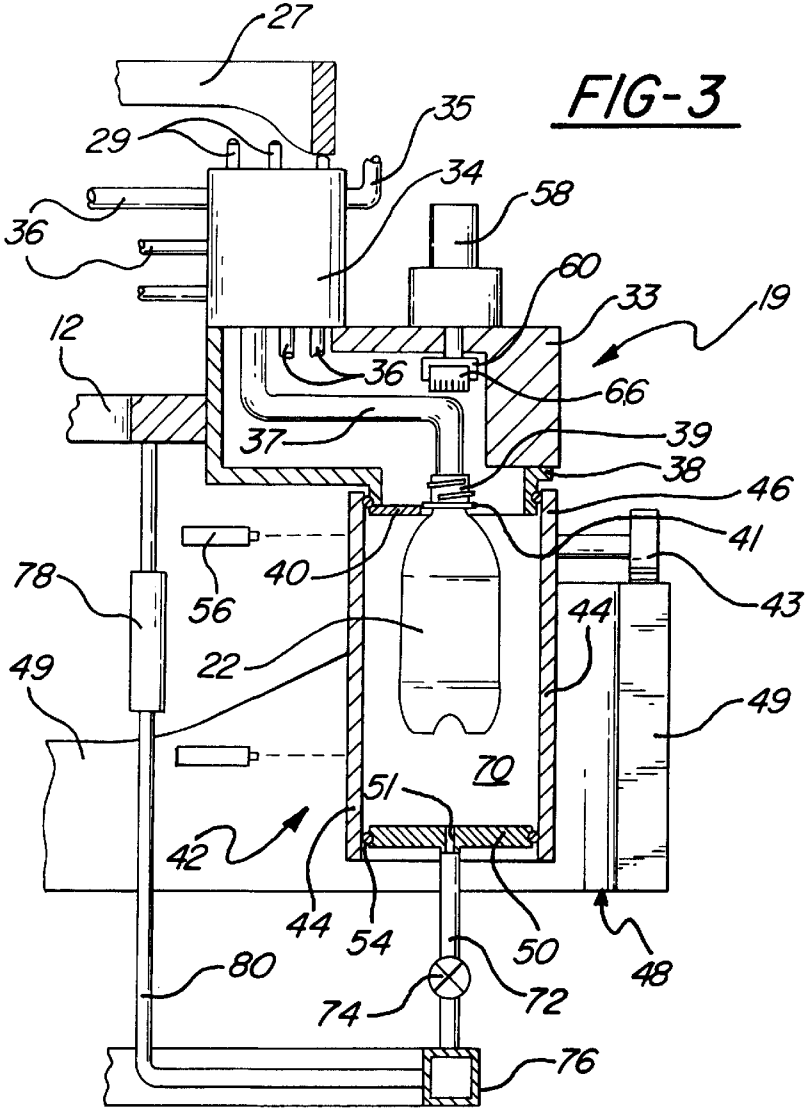
FIG. 3 is a partially cross-sectional side view of the work station during the filling of a container.

Referring also to FIGS. 2, 3, and 4, the work stations 19 are shown in greater detail. For illustrative purposes, only one work station 19 is shown and it is understood that each of the work stations 19 on the carousel 12 are substantially similar. As appreciated by those skilled in the art, the number of work stations 19 on the carousel 12 will be dependent upon the particular application as desired by the manufacturer. A typical carousel 12 may have as many as 120 work stations 19 disposed thereon. Further, there may be additional precleaning stations and even post cleaning stations surrounding the carousel 12.

Each work station 19 includes a valve station 34 supported by the carousel 12 for filling the containers 22 as the containers 22 are moved by the carousel 12 between the in-feed 20 and exit 30 stations. As can be appreciated, there will be a plurality of valve stations 34 supported by the carousel 12. Each valve station 34 may include a number of product, vacuum, pressure and air supply lines, schematically shown at 36. A filling tube 37 is rotatably mounted to the valve station 34 for swiveling into and out of alignment with the container 22. The valve stations 34 may be of the type known as volumetric filling valves. The functions of the product, vacuum, pressure, and air supply lines 36 could be accomplished by specific plungers or buttons 29 that would open or close at various times. A control bar 27 is preferably provided to selectively actuate the buttons 29. As appreciated, the control bar 27 may be replaced by an electrical device (not shown). The source of pressure or vacuum could be through a rotary assembly (not shown) or created by pressure and vacuum pumps (not shown).

A pressure tight housing 33 is supported by the carousel 12 and provides a support structure for the valve stations 34. A vent outlet 35 is disposed on the valve station 34 for selectively ventilating the housing 33 before the containers 22 are removed from the work station 19.

A downwardly projecting flange 38 extends from the housing 33 below each valve station 34. A container retainer 40 is disposed within the flange 38. As best shown in FIGS. 3 and 4, the container retainer 40 fixedly holds the container 22 in a fixed position partially disposed within the flange 38. In the preferred embodiment the container 22, or plastic bottle 22, has a neck ring 41. The neck ring 41 rests upon the container retainer 40 to support and hold the bottle 22 in position. As appreciated by those skilled in the art, the containers 22 of the subject invention are not limited to plastic bottles. The containers 22 can include aluminum or glass cans or bottles or the like without deviating from the scope of the subject invention. Further, the containers 22 may not have a rigid neck or a neck ring 41 and may be transported and held into position by different means.

An enclosure, generally shown at 42, is associated with each valve station 34 for enclosing the container 22 on the valve station 34. The enclosure 42 includes an elongated endless wall 44 with an upper periphery 46 for sealing engagement about the flange 38 of the valve station 34. The elongated endless wall 44 preferably has a substantially cylindrical configuration. It is appreciated that the endless wall 44 may be of any suitable design. An actuation mechanism 48 moves the enclosure 42 vertically between a sealed position with the upper periphery 46 in sealing engagement and an open position with the upper periphery 46 spaced vertically from the valve station 34 sufficiently for the container 22 to move out of and into the valve station 34 above the upper periphery 46. As appreciated, the vent outlet 35 ventilates the pressure, i.e., depressurizes, within the housing 33 before the elongated endless wall 44 is moved to the open position.

Figure 5:
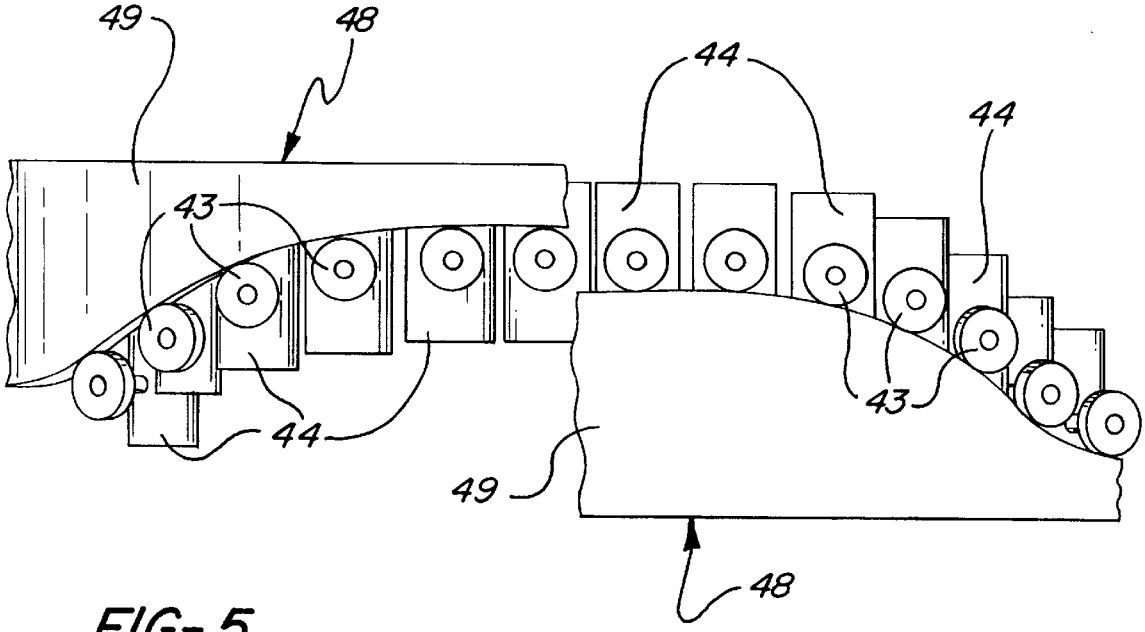
FIG. 5 is a side view of a cam rail showing the various upward and downward movements of an enclosure.
Figure 6:
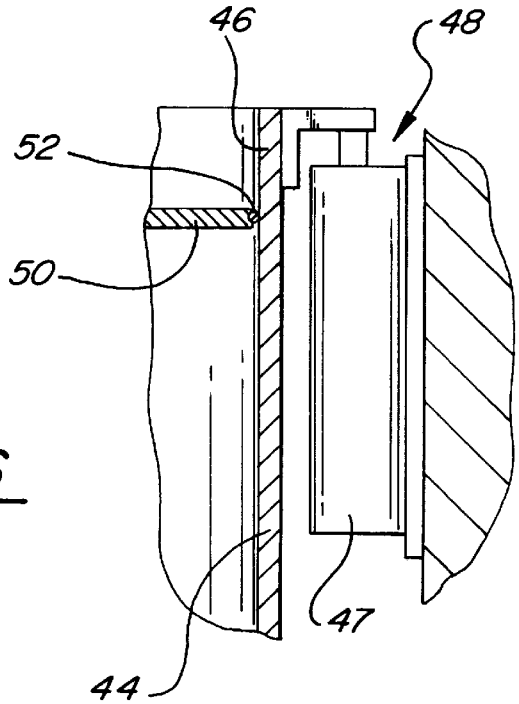
FIG. 6 is an alternative view of an actuation mechanism.

Referring also to FIG. 5, the preferred embodiment of the actuation mechanism 48 is a cam rail 49 which is fixedly mounted relative to the carousel 12. The enclosure 42 includes a roller 43 extending outwardly from the elongated endless wall 44 for engagement with the cam rail 49 to selectively move the elongated endless wall 44 between the open and sealed positions. As shown in FIG. 6, the actuation mechanism 48 is alternatively a hydraulic piston 47 for vertically actuating the endless wall 44 of the enclosure 42. As appreciated by those skilled in the art, the actuation mechanism 48 may be of any suitable design, such as a pneumatic cylinder or some other type of mechanical mechanism, without deviating from the scope of the subject invention.

The enclosure 42 is shown in the sealed position in FIGS. 3 and 4 and is shown in the open position in FIG. 2. As appreciated by those skilled in the art, the vertical movement of the endless wall 44 of the enclosure 42 allows different sized containers 22 to be mounted within the valve station 34 without changing the size of the enclosure 42. As shown in FIGS. 3 and 4, the container 22 is smaller than the enclosure 42. Hence, larger size containers 22 or even smaller size containers 22 may be mounted within the enclosure 42 without altering the design of the container filling assembly 10.

The enclosure 42 also includes a bottom 50 disposed within the elongated endless wall 44 for creating a sealed chamber 70 when the endless wall 44 is in the sealed position. Specifically, the housing 33, enclosure 42 and bottom 50 define the sealed chamber 70 for filling the container 22. The filling assembly is characterized by the bottom 50 being fixedly supported by the carousel 22 and remaining below the upper periphery 46 of the endless wall 44 during the movement of the enclosure 42 from the sealed position to the open position.

An aperture 51 is disposed within the bottom 50. A control line 72 is mounted to the bottom 50 around the aperture 51 and extends downwardly from the bottom 50 for evacuating or pressurizing the sealed chamber 70 and the container 22. A valve 74 is disposed on the control line for controlling the evacuating and pressurizing of the chamber 70 and container 22. An annular lower pipe 76 is supported by the carousel 12 and is in fluid communication with the control line 72. The lower pipe 76 extends circumferentially around the carousel 12 and is interconnected to each bottom 50 of each work station 19. A support bar 80 mounts the lower pipe 76 to the carousel 12. As appreciated, the aperture 51 and control line 72 may be of any suitable size.

The control line 72 is preferably a vacuum line for evacuating the sealed chamber 70 and the container 22. As appreciated, the control line 72 may be a pressure line. One primary advantage for having the control line 72 be the vacuum line is that the control line 72 can have a relatively larger cross-section and the valve station 34 may be simplified. Another advantage relates to the cleaning of the work station 19. As appreciated, the liquid beverage occasionally splashes within the enclosure 44 during the filling process. Hence, the sealed chamber 70 must be cleaned from time to time. The aperture 51 within the bottom 50 provides a passageway for exhausting the cleaning solution which is distributed from the valve station 34.

An adjustment mechanism 78 is mounted between the carousel 12 and the lower pipe 76 for adjusting the height of the lower pipe 76, control line 72 and bottom 50 relative to the elongated endless wall 44 for further accommodating different sized containers 22. In other words, the adjustment mechanism 78 may move the bottom 50 within the elongated endless wall 44 such that the sealed chamber 70 may be minimized in accordance with the size of the container 22. Preferably, the adjustment mechanism 78 is mounted along the support bar 80 such that the adjustment mechanism 78 moves the support bar 80 upwardly and downwardly. The upward and downward movement of the support bar 80 translates to the upward and downward movement of the lower pipe 76, control line 72 and bottom 50. For illustrative purposes, the adjustment mechanism 78 is shown schematically and it is appreciated that the adjustment mechanism 78 may be any suitable hydraulic, electronic or mechanical device.

A valve seal 52 is disposed between the upper periphery 46 of the endless wall 44 and the valve station 34. An enclosure seal 54 is disposed between the bottom 50 and the endless wall 44. In the preferred embodiment the valve seal 52 is mounted to the flange 3 8 of the valve station 44 and the enclosure seal 54 is mounted to the bottom 50. Preferably the valve seal 52 and enclosure seal 54 are of substantially the same size having substantially the same diameters for equalizing sealing forces on both ends of the elongated endless wall 44. The seals 52, 54, however, may be of any design or configuration without deviating from the overall scope of the subject invention. Due to the equal pressures on both ends of the endless wall 44, the enclosure 42 maintains its relative position to the carousel 12 without the need for additional devices. The actuation mechanism 48 is provided to move the enclosure 42 but does not maintain the enclosure 42 in the desired position. As partially shown in FIGS. 2 and 3 and more fully shown in FIG. 5, the cam rails 49 of the actuation mechanism 48 guide the roller 43 to move the endless wall 44 to the desired position. Once the endless wall 44 of the enclosure 42 is in the desired position, the endless wall 44 maintains this position without the need for any additional support.

At least one position indicator 56 is included on the container filling assembly 10 for determining the position of the elongated endless wall 44 of the enclosure 42 during the movement of the enclosure 42 from the sealed position to the open position. In the preferred embodiment two position indicators 56 are included. The position indicators 56 are shown schematically and may be mounted in any fashion or position and may be of any suitable mechanical or electrical design.

The work station 19 also includes a capping station 58. A capping station 58 is associated with each valve station 34 and supported by the carousel 12 for capping the containers 22 before the containers 22 are exited out the exit station 30. Specifically, the capping stations 58 are supported by the housing 33. For illustrative purposes, the capping station 58 is shown in a schematic form. The capping station 58 includes a downwardly projecting grasp 60 for applying a sterilized cap 66 to the containers 22. The grasp 60 snaps to, grabs, or otherwise holds the cap 66 in a desired position and may be of any suitable design so long as the caps 66 are adequately supported within the capping station 58. In the preferred embodiment, the caps 66 are mounted to an actuation shaft 62. The actuation shaft 62 vertically moves the grasp 60 from a cap reloading position as shown in FIG. 2 to a retracted position as shown in FIG. 3 and then to a capping position as shown in FIG. 4.

A cap supply station 64 is mounted in close proximity to the carousel 12 for supplying a plurality of the caps 66 to the projecting grasp 60 of the capping station 58. The cap supply station 64 may be of any suitable design without deviating from the scope of the subject invention.

In the preferred embodiment, the actuation shaft 62 positions the cap 66 onto the threaded top 39 of the container 22 and then rotates to apply a final torque necessary to complete the capping process. The rotation of the shaft 62 can be performed by a servo motor or the like (not shown). As appreciated by those skilled in the art, however, an additional capper (not shown) may be located near the exit station 30 for applying the final torque of the cap on the bottle. Hence, in the alternative embodiment, the shaft 62 would not rotate.

As shown in FIG. 1, a sterile housing 68 surrounds a portion of the chute 21 and in-feed wheel 24 of the in-feed station 20 and the chute 31 and exit wheel 32 of the exit station 30. The sterile housing 68 also surrounds the transfer station 28 and cap supply station 64 and a portion of the carousel 12. The rotation of the cap supply station 64 matches the tangential speed of the valve stations 34 on the carousel 12 at the point where the caps 66 are aligned with the grasp 60. Accordingly, the in-feed station 20, exit station 30, transfer station 28 and cap supply station 64 are all housed within a sterile environment. The additional capping station of the alternative embodiment would also be disposed within the sterile housing 68.

The method of dispensing the product into the container 22 through the plurality of valve stations 34 is now discussed in greater detail. The method comprises the steps of: feeding the container 22 from the in-feed station 24 to the carousel 12 and placing the container 22 in fluid communication with the valve station 34; disposing the endless wall 44 and bottom 50 around the container 22 to create a sealed chamber 70 for providing a sterile environment for the container 22; evacuating any fluid from the interior of the container 22 and the sealed chamber 70; pressurizing the interior of the container 22 and the sealed chamber 70; filling the container 22 with the product through the valve station 34; and removing the sealed chamber 70 from around the container 22 for the container 22 to be exited from the carousel 12 along the exit station 30. The method is characterized by moving the elongated endless wall 44 of the enclosure 42 vertically between the sealed position with the upper periphery 46 in sealing engagement with the valve station 34 to create the sealed chamber 70 and an open position with the upper periphery 46 spaced vertically from the valve station 34 and remaining above the bottom 50 for allowing the container 22 to move out of and into the valve station 34 above the upper periphery 46 and the bottom 50.

The evacuating of the interior of the container 22 and the sealed chamber 70 is further defined by evacuating through the aperture 51 in the bottom 50 below the sealed chamber 70. The vertical movement of the elongated endless wall 44 is further defined as moving the endless wall 44 relative to the bottom 50.

The capping of the containers 22 at the capping station 58 is accomplished before the containers 22 are exited from the carousel 12 along the exit station 30. Specifically, in the preferred embodiment, the capping of the containers 22 is done while the enclosure 42 is in the sealed position as shown in FIG. 4. A plurality of the caps 66 are provided to the capping station 58 by the cap supply station 64 as shown in FIG. 2.

The feeding of the containers 22 is further defined by feeding the container 22 into the precleaning station 26, into the transfer station 28, and then into the carousel 12. The containers 22 are initially transferred from the supply source to the precleaning station 26 for sufficient sterilization. Once the containers 22 are sterilized, the interior of the container 22 is not subjected to exterior air during the filling process. More specifically, the containers 22 are transported from the precleaning station 26, into the sterile housing 68, through the transfer station 28, and then mounted to the carousel 12 while the carousel 12 is in the sterile housing 68. The enclosure 42 is then actuated upwardly to the sealed position.

Once the enclosure 42 seals with the valve station 34, the fluid, typically air, is simultaneously evacuated from the interior of the container 22 and the sealed chamber 70. Hence, the pressure within the container 22 and outside the container 22 are equalized. In other words, the placing of the container 22 in the vacuum provides a means in which both the inside and the outside of the container 22 are presented with the same pressure, thereby eliminating a pressure imbalance which would otherwise collapse or deform the walls of the container 22. As discussed in the background section, this deforming is undesirable for a number of reasons.

The interior of the container 22 and the sealed chamber 70 is then simultaneously pressurized. This assures that the container 22 will not expand or balloon. The pressurized fluid traveling into the container 22 is sterile air. The filling of the container 22 is further defined by swiveling the filling tube 37 into alignment with the container 22. The product can then be dispensed into the container 22 and the sterile air is simultaneously evacuated from the container 22 as is well known in the art.

The actuation shaft 62 of the capping station 58 now descends downwardly toward the container 22 to place the cap 66 onto the threaded top 39 of the container 22. As discussed above, the shaft 62 may rotate to apply the final torque of the cap 66 onto the container 22. The entire capping process is accomplished within the sealed chamber 70.

The pressure within the sealed chamber 70 is dispersed through the vent outlet 35 after the cap 66 is applied. The enclosure 42 now descends vertically downward to the open position such that the container 22 may be removed from the valve station 34. The removal of the container 22 from the valve station 34 is completed while the valve station 34 is within the sterile housing 68. Hence, the cleaning, transferring, filling, capping and removing of the container 22 are all accomplished within a sterile, aseptic, environment. The sequential operation of the carousel 12 with these operations is critical in maintaining the aseptic environment.

An additional advantage of the subject invention is the elimination of "snifting" after filling the container 22 with the product. Snifting is a term of the art which relates to releasing the internal pressure remaining within the neck of the container 22. Foaming frequently results when this pressure is rapidly released. The snifting process is eliminated by the equation of pressures within and outside of the container 22 when the container 22 is in the sealed chamber 70.

The invention has been described in an illustrative manner, and it is to be understood that the terminology which has been used is intended to be in the nature of words of description rather than limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A container filling assembly (10) for filling a plurality of containers (22), said filling assembly (10) comprising, a carousel (12) for rotating about an axis (14), an in-feed station (20) disposed adjacent said carousel (12) for feeding empty containers (22) into said carousel (12), an exit station (30) disposed adjacent said carousel (12) for exiting filled containers (22) from said carousel (12), a plurality of valve stations (34) supported by said carousel (12) for filling the containers (22) as the containers (22) are moved by said carousel (12) between said in-feed (20) and exit (30) stations, an enclosure (42) associated with each valve station (34) for enclosing the container (22) on said valve station (34), said enclosure (42) having an elongated endless wall (44) with an upper periphery (46) for sealing engagement about said valve station (34), an actuation mechanism (48) moving said enclosure (42) vertically between a sealed position with said upper periphery (46) in said sealing engagement and an open position with said upper periphery (46) spaced vertically from said valve station (34) sufficiently for the container (22) to move out of and into said valve station (34) above said upper periphery (46), and said enclosure (42) including a bottom (50) disposed within said elongated endless wall (44) for creating a sealed chamber (70) when said endless wall (44) is in said sealed position, said assembly characterized by said bottom (50) being fixedly supported by said carousel (12) and remaining below said upper periphery (46) of said endless wall (44) during said movement of said enclosure (42) from said sealed position to said open position.

2. An assembly as set forth in claim 1 further including an aperture (51) disposed within said bottom (50).

3. An assembly as set forth in claim 2 further including a control line (72) mounted to said bottom (50) around said aperture (51) and extending downwardly from said bottom (50) for evacuating or pressurizing said sealed chamber (70) and said container (22).

4. An assembly as set forth in claim 3 further including a valve (74) disposed on said control line (72) for controlling said evacuating or said pressurizing of said sealed chamber (70) and the container (22).

5. An assembly as set forth in claim 3 further including an annular lower pipe (76) supported by said carousel (12) and in fluid communication with said control line (72).

6. An assembly as set forth in claim 5 wherein said control line (72) is a vacuum line for evacuating said sealed chamber (70) and the container (22).

7. An assembly as set forth in claim 5 further including an adjustment mechanism (78) mounted between said carousel (12) and said lower pipe (76) for adjusting the height of the lower pipe (76), control line (72) and bottom (50) relative to the elongated endless wall (44) for further accommodating different sized containers (22).

8. An assembly as set forth in claim 1 including at least one position indicator (56) determining the position of said elongated endless wall (44) of said enclosure (42) during said movement of said enclosure (42) from said sealed position to said open position.

9. An assembly as set forth in claim 1 including a valve seal (52) disposed between said upper periphery (46) of said endless wall (44) and said valve station (34) and an enclosure seal (54) disposed between said bottom (50) and said endless wall (44).

10. An assembly as set forth in claim 9 wherein said valve seal (52) and said enclosure seal (54) are of substantially the same size having substantially the same diameters for equalizing sealing forces on both ends of said elongated endless wall (44).

11. An assembly as set forth in claim 1 including a capping station (58) associated with each valve station (34) and supported by said carousel (12) for capping the containers (22) before the containers (22) are exited out said exit station (30).

12. An assembly as set forth in claim 11 wherein said capping station (58) includes a downwardly projecting grasp (60) for applying a cap (66) to the containers (22).

13. An assembly as set forth in claim 12 including a cap supply station (64) mounted in close proximity to said carousel (12) for supplying a plurality of caps (66) to said projecting grasp (60) of said capping station (58).

14. An assembly as set forth in claim 11 further including a housing (33) supported by said carousel (12) and providing a support structure for said valve stations (34) and said capping stations (58).

15. An assembly as set forth in claim 14 further including a vent outlet (35) disposed on said valve station (34) for selectively ventilating said housing (33) before said elongated endless wall (44) is moved to said open position.

16. An assembly as set forth in claim 1 wherein said actuation mechanism (48) is a cam rail (49) fixedly mounted relative to said carousel (12).

17. An assembly as set forth in claim 16 wherein said enclosure (42) further includes a roller (43) extending outwardly from said elongated endless wall (44) for engagement with said cam rail (49) to selectively move said elongated endless wall (44) between said open and sealed positions.

18. An assembly as set forth in claim 1 wherein said actuation mechanism (48) includes a hydraulic piston (47) for vertically actuating said endless wall (44) of said enclosure (42).

19. An assembly as set forth in claim 1 further including a filling tube (37) rotatably mounted to said valve station (34) for swiveling into and out of alignment with the container (22).

20. A method of dispensing a product into a container (22) through a plurality of valve stations (34) mounted to a revolving carousel (12) with the carousel (12) having an enclosure (42) associated with each valve station (34) which includes an elongated endless wall (44) with an upper periphery (46) for sealing engagement with each associated valve station (34) and a bottom (50), said method comprising the steps of:

feeding the container (22) from an in-feed station (20) to the carousel (12) and placing the container (22) in fluid communication with the valve station (34);

disposing the endless wall (44) and bottom (50) around the container (22) to create a sealed chamber (70) for providing a sterile environment for the container (22);

evacuating any fluid from the interior of the container (22) and the sealed chamber (70);

pressurizing the interior of the container (22) and the sealed chamber (70);

filling the container (22) with the product through the valve station (34); and removing the sealed chamber (70) from around the container (22) for the container (22) to be exited from the carousel (12) along an exit station (30);

said method characterized by moving the elongated endless wall (44) of the enclosure (42) vertically between a sealed position with the upper periphery (46) in sealing engagement with the valve station (34) to create the sealed chamber (70) and an open position with the upper periphery (46) spaced vertically from the valve station (34) and remaining above the bottom (50) for allowing the container (22) to move out of and into the valve station (34) above the upper periphery (46) and the bottom (50).

21. A method as set forth in claim 20 wherein the evacuating of the interior of the container (22) and the sealed chamber (70) is further defined by evacuating through an aperture (51) in the bottom (50) below the sealed chamber (70).

22. A method as set forth in claim 21 wherein the vertical movement of the elongated endless wall (44) is further defined as moving the endless wall (44) relative to the bottom (50).

23. A method as set forth in claim 22 wherein the evacuating of the fluid is further defined by simultaneously evacuating fluid from the interior of the container (22) and the sealed chamber (70).

24. A method as set forth in claim 23 wherein the pressurizing is further defined by simultaneously pressurizing the interior of the container (22) and the sealed chamber (70).

25. A method as set forth in claim 24 wherein the filling of the container (22) is further defined by swiveling a filling tube (37) into alignment with the container (22).

26. A method as set forth in claim 20 including capping the containers (22) at a capping station (58) before the containers (22) are exited from the carousel (12) along the exit station (30).

27. A method as set forth in claim 26 including providing a plurality of caps (66) to the capping station (58) by a cap supply station (64).

28. A method as set forth in claim 27 wherein the feeding of the containers (22) is further defined by feeding the container (22) into a pre-cleaning station (26), to a transfer station (28), and then to the carousel (12).

* * * * *